US007366446B2

(12) United States Patent
Sato et al.

(10) Patent No.: US 7,366,446 B2
(45) Date of Patent: Apr. 29, 2008

(54) IMAGE FORMING APPARATUS AND METHOD WITH VARIABLE PHOTOSENSITIVE DRUM TO DEVELOPING ROLLER SPEED RATIO

(75) Inventors: Fumikazu Sato, Konan (JP); Shougo Sato, Seto (JP)

(73) Assignee: Brother Kogyo Kabushiki Kaishi, Aichi-Ken (JP)

( * ) Notice: Subject to any disclaimer, the term of this patent is extended or adjusted under 35 U.S.C. 154(b) by 150 days.

(21) Appl. No.: 11/340,543

(22) Filed: Jan. 27, 2006

(65) Prior Publication Data

US 2006/0188290 A1 Aug. 24, 2006

(30) Foreign Application Priority Data

Jan. 28, 2005 (JP) ..... 2005-021989

(51) Int. Cl.
*G03G 15/00* (2006.01)
*G03G 15/08* (2006.01)

(52) U.S. Cl. ..... 399/167; 399/53

(58) Field of Classification Search ..... 399/111, 399/113, 116, 167, 53
See application file for complete search history.

(56) References Cited

U.S. PATENT DOCUMENTS

2002/0098013 A1* 7/2002 Kamimura ..... 399/167

FOREIGN PATENT DOCUMENTS

| | | |
|---|---|---|
| JP | 06-35312 | 2/1994 |
| JP | 08-146768 | 6/1996 |
| JP | 9-146325 | 6/1997 |
| JP | 10-10856 | 1/1998 |
| JP | 2001-194886 A | 7/2001 |
| JP | 2001-356590 A | 12/2001 |
| JP | 2002-72670 A | 3/2002 |

* cited by examiner

*Primary Examiner*—Hoang Ngo
(74) *Attorney, Agent, or Firm*—McDermott Will & Emery LLP

(57) ABSTRACT

An image forming apparatus includes a photosensitive drum, a developing roller, a photosensitive drum driving unit, a developing roller driving unit, and a driving control unit. An electrostatic latent image is formed on the photosensitive drum. The developing roller is disposed facing the photosensitive drum and supplies a developing agent to the electrostatic latent image formed on the photosensitive drum to develop the electrostatic latent image to developing agent image. The photosensitive drum driving unit rotatably drives the photosensitive drum. The developing roller driving unit rotatably drives the developing roller. The driving control unit controls the photosensitive drum driving unit and controls the developing roller controlling unit so that a circumferential speed ratio of the developing roller with respect to the photosensitive drum becomes a circumferential speed ratio which corresponds to a circumferential speed of the photosensitive drum.

20 Claims, 4 Drawing Sheets

IMAGE FORMING APPARATUS AND METHOD WITH VARIABLE PHOTOSENSITIVE DRUM TO DEVELOPING ROLLER SPEED RATIO

CROSS-REFERENCE TO RELATED APPLICATIONS

This application is based on and claims the benefit of priority from the prior Japanese Patent Application No. 2005-21989, filed on Jan. 28, 2005; the entire contents of which are incorporated herein by reference.

BACKGROUND OF THE INVENTION

1. Field of the Invention

The present invention relates to an image forming apparatus such as a laser printer, an image forming method and storage medium therefor.

2. Description of the Related Art

An image forming apparatus such as a laser printer includes a photosensitive drum on which electrostatic latent images are formed based on image data, a developing roller for developing the electrostatic latent images formed on the photosensitive drum into toner images, a transfer roller to which a transfer bias having a reverse polarity to the photosensitive drum is applied, and the like. The photosensitive drum and the developing roller are disposed facing each other, and are rotatably driven in predetermined directions, respectively. The developing roller holds a toner that is charged in the same polarity as the photosensitive drum. The electrostatic latent image formed on the surface of the photosensitive drum is developed into a toner image by the toner supplied from the developing roller when it faces the developing roller. Thereafter, the toner image is transferred to a sheet of paper conveyed between the photosensitive drum and a transfer roller, which is disposed facing the photosensitive drum, when the toner image faces the transfer roller.

In the image forming apparatuses thus structured, the so-called cleanerless type image forming apparatus is known in which the residual toner on the photosensitive drum after the transfer of the toner image is collected by the developing roller. Since the cleanerless type image forming apparatus does not need a cleaner device such as a blade or a reserving unit for a discarded toner, the device structure can be simplified and miniaturized, and the cost can be reduced.

However, in a cleanerless type image forming apparatus, paper dust generated from the paper that is attached to the photosensitive drum may cause a defective image forming (hereinafter, referred to as "printing of paper dust"). In other words, the paper dust attached to the photosensitive drum is charged to the same polarity as the photosensitive drum (same polarity as the toner) when the photosensitive drum is uniformly charged by a charger, thereafter, however, the paper dust is charged to the reverse polarity by being rubbed strongly with the toner held by the developing roller when it faces the developing roller. Then, the toner sticks to the paper dust, and the paper dust attached to the toner ends up being transferred to the sheet of paper.

Therefore, it has been proposed that the circumferential speed of the developing roller (moving speed of the surface of the developing roller) is set to 1.1 to 1.25 times the circumferential speed of the photosensitive drum (moving speed of the surface of the photosensitive drum) so that, even when paper dust is attached to the photosensitive drum, the paper dust is not strongly rubbed against the toner held by the developing roller, thereby preventing the occurrence of the printing of paper dust (for example, refer to JP-A-2001-356590).

SUMMARY OF THE INVENTION

However, in a type of printing apparatus where the printing mode can be selectively set between the high speed printing mode in which the circumferential speed of the photosensitive drum is set at a relatively high speed, and the low speed printing mode in which the circumferential speed of the photosensitive drum (printing speed) is set at a relatively low speed, if the circumferential speed ratio of the developing roller with respect to the photosensitive drum is set to a low range of circumferential speed ratio, for example, 1.1 to 1.25, although the printing of paper dust can be prevented from occurring in the high speed printing mode, and thus an appropriate quality of images (quality of images formed on the paper) can be obtained, a sufficient amount of toner may not be supplied to the photosensitive drum in the low speed mode because the circumferential speed of the developing roller is low, causing defective image forming.

The present invention has been made in view of the above circumstances and provides an image forming apparatus that is capable of preventing both printing of paper dust and defective image forming caused by insufficient developing agent supply to the photosensitive drum.

According to an aspect of the invention, an image forming apparatus includes a photosensitive drum, a developing roller, a photosensitive drum driving unit, a developing roller driving unit, and a driving control unit. An electrostatic latent image is formed on the photosensitive drum. The developing roller is disposed facing the photosensitive drum and supplies a developing agent to the electrostatic latent image formed on the photosensitive drum to develop the electrostatic latent image to developing agent image. The photosensitive drum driving unit rotatably drives the photosensitive drum. The developing roller driving unit rotatably drives the developing roller. The driving control unit controls the photosensitive drum driving unit and controls the developing roller controlling unit so that a circumferential speed ratio of the developing roller with respect to the photosensitive drum becomes a circumferential speed ratio which corresponds to a circumferential speed of the photosensitive drum.

According to another aspect of the invention, in an image forming method, a developing roller driving unit is controlled so that a circumferential speed ratio of a developing roller with respect to a photosensitive drum falls in a first circumferential speed ratio range, when a circumferential speed of a photosensitive drum is a first speed defined in advance, or when a number of conditions among a plurality of conditions defined in advance is equal to or more than a predetermined number. The developing roller driving unit is controlled so that the circumferential speed ratio of the developing roller with respect to the photosensitive drum falls in a second circumferential speed ratio range which is lower than the first circumferential speed ratio range, when the circumferential speed of the photosensitive drum is a second speed which is higher than the first speed, and the number of conditions among the plurality of conditions is below the predetermined number.

According to still another aspect of the invention, a storage medium is readable by a processor. The storage medium stores a program of instructions executable by the processor to perform a function for controlling an image forming apparatus. In the function, a developing roller driving unit is controlled so that a circumferential speed ratio of a developing roller with respect to a photosensitive drum falls in a first circumferential speed ratio range, when a circumferential speed of a photosensitive drum is a first speed defined in advance, or when a number of conditions among a plurality of conditions defined in advance is equal to or more than a predetermined number. The developing roller driving unit is controlled so that the circumferential speed ratio of the developing roller with respect to the photosensitive drum falls in a second circumferential speed ratio range which is lower than the first circumferential speed ratio range, when the circumferential speed of the photosensitive drum is a second speed which is higher than the first speed, and the number of conditions among the plurality of conditions is below the predetermined number.

BRIEF DESCRIPTION OF THE DRAWINGS

These and other objects and advantages of this invention will become more fully apparent from the following detailed description taken with the accompanying drawings in which.

DESCRIPTION OF THE EMBODIMENTS

<General Structure of Color Laser Printer>

Figure 1:
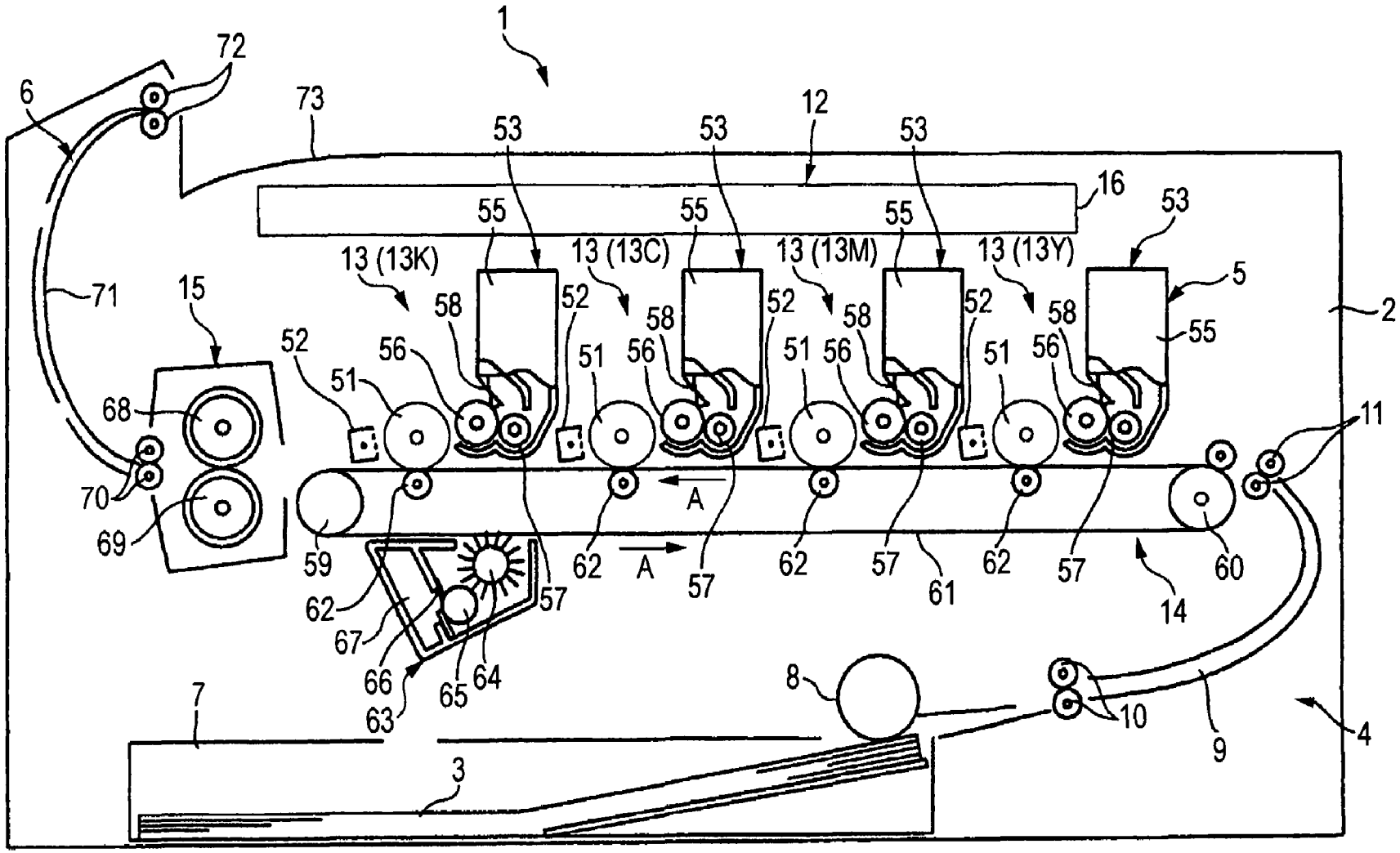
FIG. 1 is a side cross sectional view showing one embodiment of a color laser printer as the image forming apparatus according to an embodiment.

FIG. 1 is a side cross sectional view showing an embodiment of a color laser printer as the image forming apparatus of the present invention.

The color laser printer 1 is a horizontal type tandem color laser printer in which process units 13 for the respective colors, i.e., yellow, magenta, cyan, and black, which will be described later, are arranged in tandem with each other in a horizontal direction. The printer 1 also includes a box-shaped main casing 2 in which are provided a paper feeding unit 4 for feeding sheets of paper 3 as a recording medium, an image forming section 5 for forming images on the sheets of paper 3 that are supplied by the paper feeding unit 4, and a paper discharge section 6 for discharging the paper 3 after images are formed thereon.

<Structure of Paper Feeding Unit>

The paper feeding unit 4 includes a paper cassette 7 that is provided on the bottom of the main casing 2, a feeding roller 8 provided above the front side of the paper cassette 7 (hereinafter, the direction to the right in FIG. 1 is denoted as the "front side", and the direction to the left is denoted as the "rear side"), a feeding path 9 provided above the front side of the feeding roller 8, a pair of conveying rollers 10 provided in the feeding path 9, and a pair of registration rollers 11 disposed at the downstream side end of the feeding path 9.

Sheets of paper 3 are stacked in the paper cassette 7. The topmost sheets of the paper 3 are supplied toward the feeding path 9 by the rotation of the feeding roller 8.

The feeding path 9 is formed as a conveying path of the sheets of paper 3 having an approximately U-shape. As such, the upstream side end of the feeding path 9 is adjacent to the feeding roller 8 at the lower portion so that the sheets of paper 3 are fed toward the front direction, and, the downstream side end of the feeding path 9 is adjacent to the conveying belt 61 at the upper portion, which will be described below, so that the sheets of paper 3 are discharged toward the rear direction.

Hence, a sheet of paper 3 supplied toward the feeding path 9 is conveyed by the conveying rollers 10 in the feeding path 9, and its conveying direction is reversed in front-rear direction. After the registration by the registration rollers 11, the sheet of paper 3 is fed toward the rear direction by the registration rollers 11.

<Structure of Image Forming Section>

The image forming section 5 includes a scanner unit 12, processing units 13, a transfer unit 14, and a fixing unit 15.

<Structure of Scanner Unit>

The scanner unit 12 is disposed over the plurality of process units 13, which will be described below, in the upper portion of the main casing 2.

Figure 2:
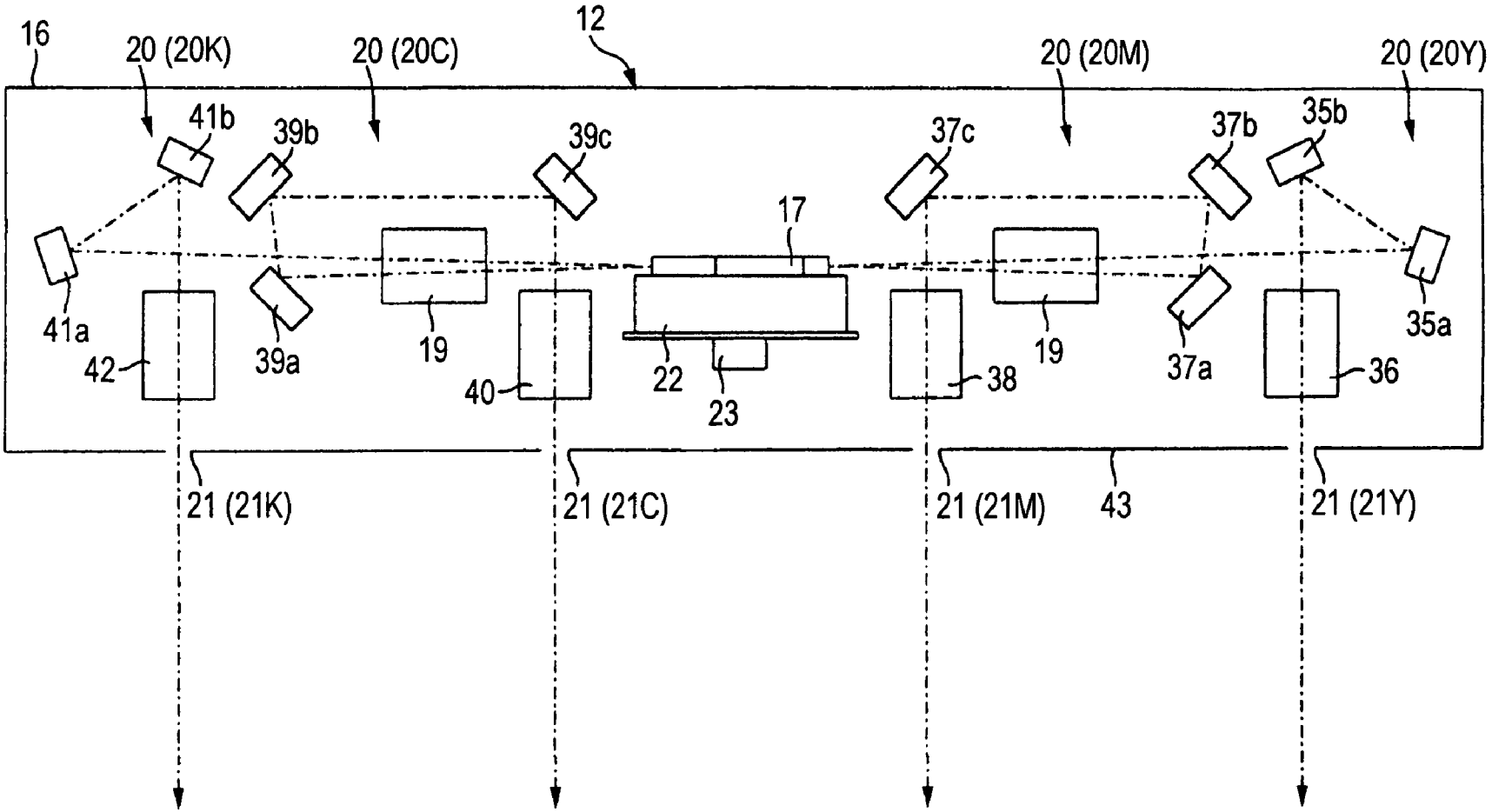
FIG. 2 is a side cross sectional view of the scanner unit shown in FIG. 1.

FIG. 2 is a side cross sectional view of the scanner unit 12.

The scanner unit 12 includes a scanner casing 16, a polygon mirror 17, which is provided in the scanner casing 16, for polarizing and scanning laser light beams from laser light sources (not shown) provided corresponding to the respective colors, fθ lenses 19 for converting the polarized and scanned light beams from the polygon mirror 17 into parallel light flux with an equal speed, and laser-emitting optical units 20 for emitting the laser light beams passing through the fθ lenses 19 as laser light beams corresponding to the respective colors.

The scanner casing 16 has a box-shape, and light-emitting windows 21 corresponding to the respective colors are formed on the bottom wall thereof. Each of the light-emitting windows 21 is provided with a gap each other at a different location in the front-rear direction. The light-emitting windows are formed, sequentially for the respective colors from front to rear, as a yellow light-emitting window 21Y, a magenta light-emitting window 21M, a cyan light-emitting window 21C, and a black light-emitting window 21K.

The polygon mirror 17 is provided on a motor substrate 22 at the center portion of the horizontal direction in the scanner casing 16. The polygon mirror 17 is constituted of a polyhedron (for example, a hexahedron) having a plurality of reflective surfaces, and is rotatably driven at a high speed by a dynamic force of a scanner motor accommodated in the motor substrate 22 around the rotational shaft 23 provided at its center.

The laser-emitting optical units 20 are provided for the respective colors. In other words, the laser-emitting optical units 20 consist of four optical units, i.e., a yellow optical unit 20Y, a magenta optical unit 20M, a cyan optical unit 20C, and a black optical unit 20K, each of which corresponds to each of the colors.

The yellow optical unit 20Y is disposed at the utmost front side in the horizontal direction, and includes two reflective mirrors 35*a* and 35*b*, that reflect the laser light beam passing through the upper side of either fθ lens 19, and a cylindrical lens 36 that collects the laser light beam reflected by the reflective mirrors 35*a* and 35*b*. In the yellow optical unit 20Y, the laser light beam passing through the upper side of either fθ lens 19 is reflected obliquely upwards in the rear direction by the reflective mirror 35*a*, and thereafter, is reflected downwards in a perpendicular direction by the reflective mirror 35*b*, passes through the cylindrical lens 36 in a perpendicular direction, and is emitted from the yellow emitting window 21Y towards the photosensitive drum 51 of the yellow process unit 13Y which will be described below.

The magenta optical unit 20M is disposed between the polygon mirror 17 and the yellow optical unit 20Y, and includes three reflective mirrors 37*a*, 37*b*, and 37*c*, that reflect the laser light beam passing through the lower portion of either fθ lens 19, and a cylindrical lens 38 that collects the laser light beam reflected by the reflective mirrors 37*a*, 37*b*, and 37*c*. In the magenta optical unit 20M, the laser light beam passing through the lower portion of either fθ lens 19 is reflected upwards by the reflective mirror 37*a*, is reflected backwards by the reflective mirror 37*b*, and thereafter, is reflected downwards in a perpendicular direction by the reflective mirror 37*c*, passes through the cylindrical lens 38 in a perpendicular direction, and is emitted from the magenta emitting window 21M towards the photosensitive drum 51 of the magenta process unit 13M which will be described below.

The cyan optical unit 20C is disposed between the polygon mirror 17 and the black optical unit 20K, and includes three reflective mirrors 39*a*, 39*b*, and 39*c*, that reflect the laser light beam passing through the lower side of the other fθ lens 19, and a cylindrical lens 40 that collects the laser light beam reflected by the reflective mirrors 39*a*, 39*b*, and 39*c*. In the cyan optical unit 20C, the laser light beam passing through the lower portion of the other fθ lens 19 is reflected upwards by the reflective mirror 39*a*, is reflected forwards by the reflective mirror 39*b*, and thereafter, is reflected downwards in a perpendicular direction by the reflective mirror 39*c*, passes through the cylindrical lens 40 in a perpendicular direction, and is emitted from the cyan emitting window 21C towards the photosensitive drum 51 of the cyan process unit 13C which will be described below.

The black optical unit 20K is disposed at the utmost rear side in the horizontal direction, and includes two reflective mirrors 41*a* and 41*b*, that reflect the laser light beam passing through the upper portion of the other fθ lens 19, and a cylindrical lens 42 that collects the laser light beam reflected by the reflective mirrors 41*a* and 41*b*. In the black optical unit 20K, the laser light beam passing through the upper portion of the other fθ lens 19 is reflected obliquely upwards in a forward direction by the reflective mirror 41*a*, and thereafter, is reflected downwards in a perpendicular direction by the reflective mirror 41*b*, passes through the cylindrical lens 42 in a perpendicular direction, and is emitted from the black emitting window 21K towards the photosensitive drum 51 of the black process unit 13K which will be described below.

It is noted that the magenta optical unit 20M and the cyan optical unit 20C are symmetrically disposed with respect to the polygon mirror 17, and the yellow optical unit 20Y and the black optical unit 20K are symmetrically disposed with respect to the polygon mirror 17 outside the magenta optical unit 20M and the cyan optical unit 20C.

<Structure of Process Units>

As shown in FIG. 1, a plurality of process units 13 is provided so as to correspond to a plurality of colors of toners. In other words, the process units 13 consist of a yellow process unit 13Y, a magenta process unit 13M, a cyan process unit 13C, and a black process unit 13K. These process units 13 are sequentially disposed in tandem so as to be overlapped in the horizontal direction with gaps therebetween each other from front to rear.

Each of the processor units 13 includes a photosensitive drum 51, a scorotron type charger 52, and a developing cartridge 53.

The photosensitive drum 51 takes the form of a cylinder, and includes a drum body, and a drum shaft that extends in the center of axle of the drum body in the axial direction of the drum body. The drum body is formed of positively chargeable photosensitive layers including an outermost layer that is formed of polycarbonate, etc. The drum body is rotatably provided with respect to the drum shaft, and the drum shaft is non-rotatably supported by both sidewalls in the lateral direction of each of the process units 13 (the direction perpendicular both to the horizontal direction and to the vertical direction, which is to be applied hereinafter). At the time of image formation, the photosensitive drum 51 is rotatably driven in the same direction as the moving direction of the conveying belt 61 (clockwise in the drawing) at the contacting location with the conveying belt 6 to be described below by the driving force input from the drum motor 85, which will be described below.

The scorotron type charger 52 includes a wire and a grid. The charger 52 is of a positive charging type which is capable of occurring a corona discharge by the application of a charging bias and is disposed to be opposite to the photosensitive drum 51 with a gap.

The developing cartridge 53 includes a developing roller 56, a toner supply roller 57, and a toner-layer thickness regulator blade 58 in its cylindrical body.

The developing roller 56 is disposed facing the photosensitive drum 51 at a position in front of the photosensitive drum 51, and is held in pressing contact with the photosensitive drum 51. The developing roller 56 is formed of a metallic roller shaft that is coated by a roller portion made of an elastic member such as a conductive rubber material. More specifically, the roller portion has a two-layer structure including an elastic roller layer formed of electrically conductive urethane rubber, silicon rubber, or EPDM rubber, etc., which contains, for example, fine particles of carbon, and a coating layer which is coated on the surface of the roller layer and is formed of urethane rubber, urethane resin, or polyimide resin, etc., as its major component. Also, the roller shaft of the developing roller 56 is rotatably supported by both lateral sidewalls of each of the process units 13. Hence, when images are formed, a developing bias is applied to the roller shaft of the developing roller 56 and a driving force is input thereto from the developing motor 86, which will be described below. Through this driving force, the developing roller 56 is rotatably driven in the opposite direction (counterclockwise in the drawing) to the photosensitive drum 51.

The toner supply roller 57 is disposed facing the developing roller 56 at a position in front of the developing roller 56, and is held in pressing contact with the developing roller 56. The toner supply roller 57 is formed of a metallic roller shaft that is coated by a roller portion made of an electrically conductive sponge member. Also, the roller shaft of the toner supply roller 57 is rotatably supported by both lateral sidewalls of each of the process units 13.

The toner-layer thickness regulator blade 58 is formed of a metallic sheet spring material, and includes a presser member having a semi-circular shape in cross section and is formed of an electrically insulating silicon rubber at its distal end portion. Hence, the toner-layer thickness regulator blade 58 is supported by the cylindrical body of the developing cartridge 53 at a position above the developing roller 56, such that the presser member at its distal end portion (lower end portion) is held in pressing contact with the developing roller 56 from the front upward direction.

Furthermore, the upper portion of the cylindrical body of the developing cartridge 53 is formed as a toner chamber 55 that accommodates a toner, and toners for the respective colors are accommodated therein. In other words, the toner chamber 55 in the yellow process unit 13Y accommodates a positively chargeable non-magnetic one-component polymerized toner of yellow color. The toner chamber 55 in the magenta process unit 13M accommodates a positively chargeable non-magnetic one-component polymerized toner of magenta color. The toner chamber 55 in the cyan process unit 13C accommodates a positively chargeable non-magnetic one-component polymerized toner of cyan color. The toner chamber 55 in the black process unit 13K accommodates a positively chargeable non-magnetic one-component polymerized toner of black color.

More specifically, an approximately spherical polymerized toner obtained by a polymerization method is used for each of the toners for the respective colors. The polymerized toner has a binding resin as its major component that is produced by co-polymerizing, in a known polymerizing method such as suspension polymerization, styrene monomers such as styrene, or acrylic monomers such as acrylic acid, alkyl (C1-C4) acrylate and alkyl (C1-C4) methacrylate. Mother particles of the toner are formed by mixing coloring agents, charge controlling agents, and the like, thereto, and external additives to improve the degree of fluidity are also mixed.

Each of the coloring agents for the above-mentioned yellow, magenta, cyan, and black is mixed. Furthermore, as a charge controlling agent, a charge controlling resin is mixed that can be obtained from the co-polymerization of ionic monomers having ionic functional group such as, for example, ammonium salt, and monomers that can be co-polymerized with ionic monomers such as styrene monomers or acrylic monomers. Furthermore, as an external additive, metal oxide powder such as silica, aluminum oxide, titanium oxide, strontium titanate, cerium oxide, magnesium oxide, or the like, or inorganic powder such as carbonate powder, metallic salt powder, or the like, is mixed.

Hence, in each of the process units 13, when an image is formed, the toner of the respective colors accommodated in each of the toner chambers 55 is supplied to the toner supply roller 57, and in turn is supplied to the developing roller 56 by the rotation of the toner supply roller 57. At that time, the toner is positively charged by friction between the toner supply roller 57 and the developing roller 56 to which a developing bias is applied. The toner supplied on the developing roller 56 enters between the toner-layer thickness regulator blade 58 and the developing roller 56 with the rotation of the developing roller 56, and becomes a thin layer with a predetermined thickness and is held on the developing roller 56.

On the other hand, the scorotron type charger 52 generates a corona discharge by the application of a charging bias such that the surface of the photosensitive drum 51 is uniformly positively charged. The surface of the photosensitive drum 51 is uniformly positively charged by the scorotron type charger 52 with the rotation of the photosensitive drum 51, and thereafter, is exposed by high speed-scanning of the laser light beam emitted from the light-emitting window 21 of the scanner unit 12, and an electrostatic latent image of the respective colors corresponding to the image that is to be displayed on the paper 3 is formed.

Furthermore, when the photosensitive drum 51 is rotated, the toner that is held on the surface of the developing roller 56 and is also positively charged, is supplied to the electrostatic latent image formed on the photosensitive drum 51, i.e., the exposed portions which are exposed by the laser light beam and thus have lower electric potential in the surface of the photosensitive drum 51 that is uniformly positively charged, when the toner is oppositely held in contact with the photosensitive drum 51 by the rotation of the developing roller 56. Through this, the electrostatic latent image on the photosensitive drum 51 becomes visible, and the surface of the photosensitive drum 51 assumes the toner image by the reverse development corresponding to the respective colors.

<Structure of Transfer Unit>

The transfer unit 14 is disposed on the upper side of the paper cassette 7 in the main casing 2, and along the horizontal direction in the lower side of the process units 13. The transfer unit 14 includes a driving roller 59, a driven roller 60, a conveying belt 61, a transfer roller 62 as a transfer unit, and a belt cleaning unit 63.

The driving roller 59 is disposed below the rear side of the photosensitive drum 51 in the black process unit 13K. When an image is formed, the driving roller 59 is rotatably driven in the opposite direction (counterclockwise in the drawing) to the rotational direction of the photosensitive drum 51.

The driven roller 60 is disposed below the front side of the photosensitive drum 51 in the yellow process unit 13Y so that it faces the driving roller 59 in the horizontal direction. The driven roller 60 is rotatably driven in the same direction (counterclockwise in the drawing) as the rotating direction of the driving roller 59 at the time of rotational driving of the driving roller 59.

The conveying belt 61 is an endless belt made from a resin such as conductive polycarbonate or polyimide, having conductive particles, such as carbon, dispersed therein. The conveying belt 61 is stretched between the driving roller 59 and the driven roller 60, and is disposed so that the contacting surface of the outer side of the conveying belt 61 thus stretched is oppositely brought into contact with all of the photosensitive drums 51 of the respective process units 13.

Hence, the driven roller 60 is driven by the driving roller 59, and the conveying belt 61 is circularly moved between the driving roller 59 and the driven roller 60 in the direction shown as Arrow A (counterclockwise in the drawing) so that it is rotated in the same direction as the photosensitive drum 51 on the contacting surface that is oppositely brought into contact with the photosensitive drum 51 of each of the process units 13.

In the conveying belt 61 stretched between the driving roller 59 and the driven roller 60, each of the transfer rollers 62 is disposed facing the photosensitive drum 51 of each of the process units 13 with the conveying belt 61 sandwiched therebetween. Each of the transfer rollers 62 is formed of a metallic roller shaft that is coated by a roller portion made of an elastic member such as an electrically conductive rubber material. Hence, the roller shaft of each of the transfer rollers 62 extends along the lateral direction, and is rotatably supported. At the time of transfer, a transfer bias is applied to the shaft of the transfer roller 62. Each of the transfer rollers 62 rotates in the same direction as the circular moving direction of the conveying belt 61 (counterclockwise in the drawing) on the contacting surface that is oppositely brought into contact with the conveying belt 61.

Thereafter, the sheet of paper 3 supplied from the paper feeding unit 4 is conveyed, from front to rear, by the conveying belt 61 which is circularly moved by the driving of the driving roller 59 and the driven roller 60 so that the sheet of paper 3 sequentially passes through the image forming location between the conveying belt 61 and the photosensitive drum 51 of each of the process units 13. Hence, during the conveyance, the toner image corresponding to each of the colors held by the photosensitive drum 51 of each of the process units 13 is sequentially transferred, and thus, a color image is formed on the sheet of paper 3.

In other words, for example, after a yellow toner image held on the surface of the photosensitive drum 51 of the yellow process unit 13Y is transferred onto the sheet of paper 3, a magenta toner image held on the surface of the photosensitive drum 51 of the magenta process unit 13M is transferred in an overlapped manner onto the sheet of paper 3 on which the yellow toner image has already been transferred. By the similar operation, a cyan toner image held on the surface of the photosensitive drum 51 of the cyan process unit 13C and a black toner image held on the surface of the photosensitive drum 51 of the black process unit 13K are transferred in an overlapped manner onto the sheet of the paper 3, and thus, a color image is formed on the sheet of paper 3.

In the formation of the color image, since the color laser printer 1 has the tandem structure in which a plurality of process units 13 are provided corresponding to the respective colors in each of the process unit 13, the toner image corresponding to each of the colors can be formed at almost the same speed as that of the formation of a monochrome image, and thus, a rapid color image formation can be accomplished. Therefore, device miniaturization can be pursued and color images can be formed.

The belt cleaning unit 63 is disposed under the conveying belt 61 facing the black process unit 13K while they are sandwiching the conveying belt 61.

The belt cleaning unit 63 includes a first cleaning roller 64, disposed in contact with the surface of the conveying belt 61, for scraping off paper dust, a toner, or the like, attached on the surface of the conveying belt 61, a second cleaning roller 65, disposed in contact with the first cleaning roller 64, for electrically collecting paper dust, toner, or the like, scraped off by the first cleaning roller 64, a scraping blade 66, being in contact with the second cleaning roller 65, for scraping off paper dust, toner, or the like, collected by the second cleaning roller 56, and a cleaning box 67 for reserving paper dust, toner, or the like, scrapped off by the scrape blade 66.

In the belt cleaning unit 63, paper dust, toner, or the like, attached on the surface of the conveying belt 61 is first scraped off by the first cleaning roller 64, and the powder, toner, or the like, scraped off by the first cleaning roller 64 is electrically collected by the second cleaning roller 65. Thereafter, the paper, toner, or the like, collected by the second cleaning roller 65 is scraped off by the scrape blade 66, and reserved in the cleaning box 67.

<Structure of Fixing Unit>

The fixing unit 15 is disposed behind the transfer unit 14. The fixing unit 15 includes a thermal roller 68, a pressing roller 69, and conveying rollers 70. The thermal roller 68 is a metallic tube, and a mold releasing layer is formed on its surface. A halogen lamp is mounted along the axis direction of the thermal roller 68. The surface of the thermal roller 68 is heated to a fixing temperature by the halogen lamp. Also, the pressing roller 69 is provided so as to press against the thermal roller 68. Also, the conveying rollers 70 consist of a pair of rollers, upper and lower rollers, and are disposed behind the thermal roller 68 and the pressing roller 69.

Hence, the color image transferred on the sheet of paper 3 is thereafter conveyed to the fixing unit 15. The color image is thermally fixed on the paper 3 by heating and pressing while the sheet of paper 3 passes through the thermal roller 68 and the pressing roller 69. The thermally fixed sheet of paper 3 is sent to the paper discharge section 6 by the conveying rollers 70.

<Structure of Paper Discharge Section>

The paper discharge section 6 includes a discharge path 71, discharge rollers 72, and a discharge tray 73.

The discharge path 71 is formed of approximately U-shape as a conveying path. The upstream end of the discharge path 71 is adjacent to the conveying rollers 70 on the lower side so that the sheet of paper 3 is conveyed backwards, and its downstream end is adjacent to the discharge rollers 72 on the upper side so that the paper 3 is discharged forwards.

The discharge rollers 72 are provided to the downstream end of the discharge path 71 as a pair of rollers.

The discharge tray 73 is formed as a slanted wall that is slanted downward from front to rear on the upper surface of the main casing 2.

The conveying direction of the sheet of paper 3 sent from the conveying rollers 70 is reversed in the horizontal direction in the paper discharge path 71, and then, is discharged forwards by the discharge rollers 72. The discharged paper 3 is placed on the paper discharge tray 73.

Furthermore, in the present color laser printer 1, the residual toner remaining on the surface of the photosensitive drum 51 after the toner was transferred onto the sheet of paper 3 by each of the transfer rollers 62 is collected by the developing roller 56, i.e., the residual toner is collected by the so called cleanerless method. If the toner remaining on the photosensitive drum 51 is collected by the cleanerless method, a toner cleaner device or a reserving unit for discharged toners is not needed, and thus the device structure is simplified.

<Structure of Control Section>

Figure 3:
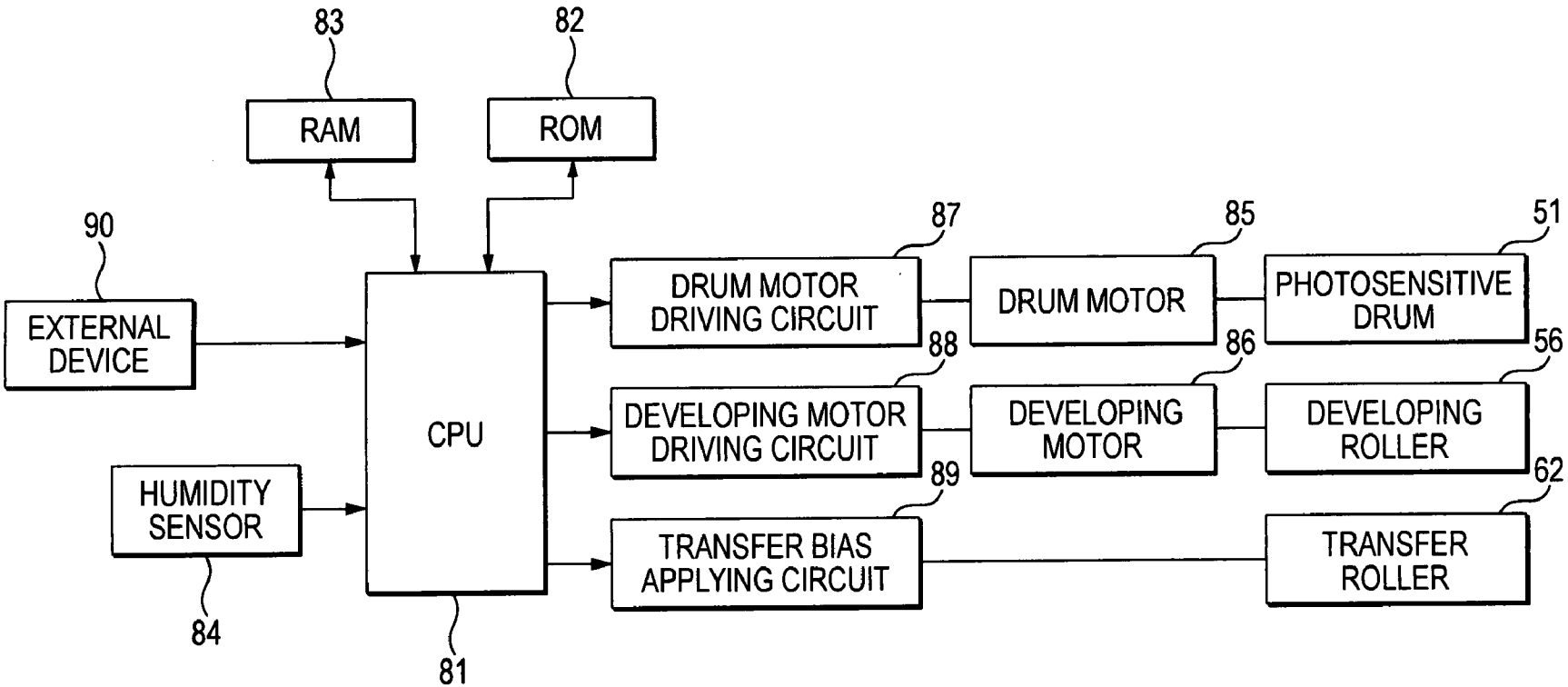
FIG. 3 is a block diagram showing the control system for controlling the circumferential speeds of the photosensitive drum and the developing roller shown in FIG. 1.

FIG. 3 is a block diagram showing a control section for controlling the rotational speed of the photosensitive drum 51 and the developing roller 56.

The color laser printer 1 includes a CPU 81 as a driving control unit, a ROM 82, and a RAM 83 as a count recording unit.

The ROM 82 stores a program for controlling each section in the color laser printer 1.

The RAM 83 is used as a work area when the CPU 81 executes the program stored in the ROM 82. Furthermore, the RAM 83 has the backup function, and is used for recording the number of image forming operations executed in the past in the color laser printer 1.

The CPU 81 is connected to a humidity sensor 84 as a humidity detecting unit for detecting the humidity in the environment around the developing roller, and detection signal from the humidity sensor 84 is input to the CPU 81. Furthermore, from an external device 90 which is connected to the color laser printer 1 (for example, a personal computer), various signals such as the signals showing the contents set by the user in an external device 90, signals instructing the start of operation to form an image to the paper 3 (image forming operation), or the like, are input to the CPU 81.

Furthermore, in the external device, at the time of selection, the user can set the high speed mode in which the image forming operation is performed in a high speed (for example, 20 ppm) to the color laser printer 1, and the fine mode in which the image forming operation is performed in a lower speed (16 ppm) than in the high speed mode but more precise image can be formed on the paper 3. Furthermore, the user can set the type of the paper 3 such as, whether the paper 3 used in the color laser printer 1 is normal paper or abnormal paper other than normal paper (recycled paper, etc.), whether it is special paper such as thick paper or narrow-width paper, or whether it is thin paper such as copy paper.

Furthermore, the color laser printer 1 includes, in the main casing 2, a drum motor 85 as a photosensitive drum driving unit for generating the rotational driving force of the photosensitive drum 51, and a developing motor 86 as a developing roller driving unit for generating the rotational driving force of the developing roller 56. A drum motor driving circuit 87 and a developing motor driving circuit 88 for driving these motors are connected to the CPU 81 as control targets.

Furthermore, the CPU 81 is connected to a transfer bias applying circuit 89 as a bias switching unit for applying a transfer bias to the transfer rollers 62 as a control target.

Based on the signal input from the external device 90 and the detection signal input from the humidity sensor 84, the CPU 81 controls the driving of the drum motor 85 through the drum motor driving circuit 87 and the driving of the developing motor 86 through the developing motor driving circuit 88 so that the circumferential speeds (moving speeds of the surface) of the photosensitive drum 51 and the developing roller 56 can be determined by the circumferential speed determining process to be described below.

Furthermore, the CPU 81 controls the transfer bias applying circuit 89 so as to control the transfer bias applied from the transfer bias applying circuit 89 to the transfer rollers 62. More specifically, the CPU 81 controls the transfer bias applying circuit 89 so that, in the external device 90, a relatively high transfer bias is applied to the transfer rollers 62 when special paper is set as the paper 3 used in the color laser printer 1, and a relatively low transfer bias is applied to the transfer rollers 62 when thin paper is set as the paper 3.

Furthermore, after the image forming operation is complete, the CPU 81 increments (+1) the number of counts of the image forming operations recorded in the RAM 83.

Figure 4:
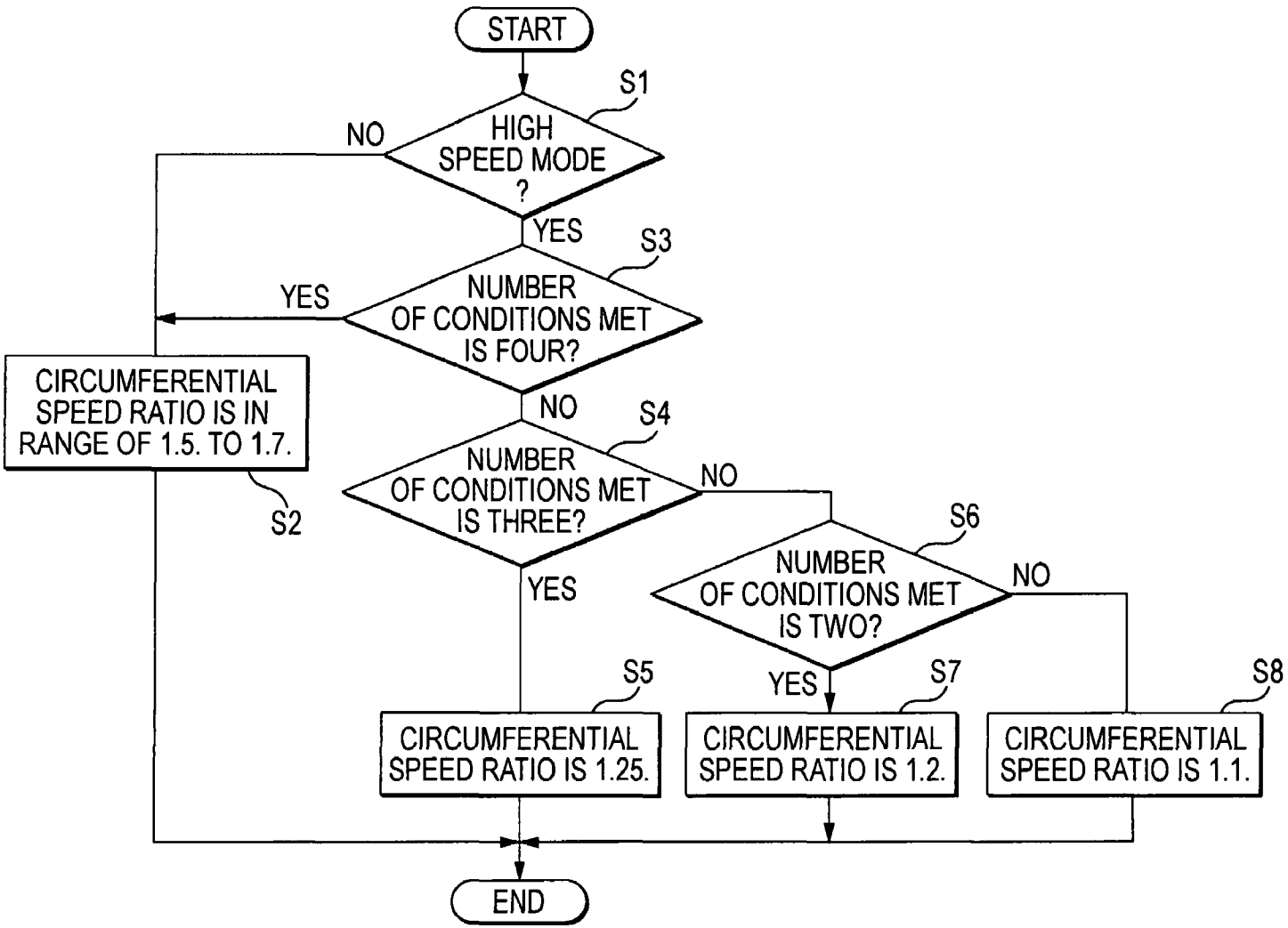
FIG. 4 is a block diagram showing the flow of the circumferential speed determining process performed by the CPU shown in FIG. 3.

FIG. 4 is a flow chart showing the flow of the circumferential speed determining process.

In response to performance of various settings in the external device 90 and reception of signals indicative of such settings and signals instructing the start of the image forming operation, the CPU 81 performs the circumferential speed determining process shown in FIG. 4 before starting the driving of the photosensitive drum 51, the developing roller 56, and the like.

In the circumferential speed determining process, it is determined whether the high speed mode is set in the external device 90 (S1). If the high speed mode is not set, i.e., the fine mode is set (S1: NO), the circumferential speed of the photosensitive drum 51 is determined so that the speed of the image forming operation is 16 ppm (the speed at which images can be formed on 16 sheets of paper 3 per one minute). Also, the circumferential speed of the developing roller 56 is determined so that the ratio of circumferential speed of the developing roller 56 with respect to the speed of the photosensitive drum 51 becomes a predetermined value within the range of 1.5 to 1.7 (S2).

On the other hand, if the high speed mode is set (S1: YES), the circumferential speed of the photosensitive drum 51 is set so that the speed of the image forming operation is 20 ppm (the speed at which images can be formed on 20 sheets of paper 3 per one minute). Furthermore, it is determined whether each of four conditions is satisfied or not, and also, it is determined whether the number of satisfied conditions among the four conditions is four or below four (S3).

Here, Conditions 1 to 4 described below are defined in advance as four conditions.

1. In the external device 90, thin paper is set for the type of paper 3.
2. The humidity detected by the humidity sensor 84 is equal to or below 50%.
3. In the external device 90, normal paper is set for the type of paper 3.
4. The number of image forming operations performed in the past is equal to or less than 10,000 (about half of the number of sheets of print paper during the lifetime of the photosensitive drum 51, which is around 20,000 (the number of image forming operations is around 20,000)).

Each of these four conditions is a condition in which printing of paper dust is harder to occur. In other words, if all four conditions are met, printing of paper dust is hardest to occur, while, if none of the conditions is met, printing of paper dust is easiest to occur.

If all four conditions are met (S3: YES), the circumferential speed of the developing roller 56 is determined so that the circumferential speed ratio of the developing roller 56 with respect to the photosensitive drum 51 becomes a predetermined value within the range of 1.5 to 1.7.

If three or less conditions are met among the four conditions (S3: NO), the circumferential speed of the developing roller 56 is determined so that the circumferential speed ratio of the developing roller 56 with respect to the photosensitive drum 51 is included in the range 1.1 to 1.25.

More specifically, if three or less conditions are met among the four conditions, it is determined whether the conditions met are three or less (S4). Thereafter, if the number of conditions met are three (S4: YES), the circumferential speed of the developing roller 56 is determined so that the circumferential speed ratio of the developing roller 56 with respect to the photosensitive drum 51 becomes 1.25 (S5).

Also, If two or less conditions are met among the four conditions (S4: NO), it is determined whether the number of conditions met is two, or less than two (S6). Thereafter, if the number of conditions met are two (S6: YES), the circumferential speed of the developing roller 56 is determined so that the circumferential speed ratio of the developing roller 56 with respect to the photosensitive drum 51 becomes 1.2 (S7).

On the other hand, if the number of conditions met among the four conditions is 1 or less (1 or 0) (S6: NO), the circumferential speed of the developing roller 56 is determined so that the circumferential speed ratio of the developing roller 56 with respect to the photosensitive drum 51 becomes 1.1 (S8).

By determining the circumferential speed of the developing roller 56 as described above, the circumferential speed of the developing roller 56 can be made appropriate according to the circumferential speed of the photosensitive drum 51. As a result, both printing of paper dust and defective image forming caused by the insufficient toner supply to the photosensitive drum 51 can be prevented, and thus, high-quality images can always be formed.

In other words, if the photosensitive drum 51 should be rotatably driven so that the speed of the image forming operation is 16 ppm (fine mode), or if all four conditions in which printing of paper dust is harder to occur are met, the circumferential speed of the developing roller 56 is determined so that the circumferential speed ratio of the developing roller 56 with respect to the photosensitive drum 51 falls in the range of 1.5 to 1.7. Also, the developing motor driving circuit 88 is controlled by the CPU 81 so that the developing roller 56 is rotatably driven at the determined circumferential speed. On the other hand, if the photosensitive drum 51 should be rotatably driven so that the circumferential speed of the photosensitive drum 51 is 20 ppm (high speed mode), and if three or less conditions are met among the four conditions, the circumferential speed of the developing roller 56 is determined so that the circumferential speed ratio of the developing roller 56 with respect to the photosensitive drum 51 falls in the range of 1.1 to 1.25. Also, the developing motor driving circuit 88 is controlled by the CPU 81 so that the developing roller 56 is rotatably driven at the determined circumferential speed.

For example, when the printer 1 is in the fine mode in which the circumferential speed of the photosensitive drum 51 is a low speed, or all four conditions are met, printing of paper dust is harder to occur, and therefore, the circumferential speed of the developing roller 56 is determined so that the circumferential speed ratio of the developing roller 56 with respect to the photosensitive drum 51 falls in the range of 1.5 to 1.7, which is a relatively high value range. Since printing of paper dust can be prevented from occurring by rotatably driving the developing roller 56 at the circumferential speed, the circumferential speed of the developing roller 56 can certainly be prevented from becoming too low. Therefore, both printing of paper dust and defective image forming caused by the insufficient toner supply to the photosensitive drum 51 can be prevented.

On the other hand, when the printer is in the high speed mode in which the circumferential speed of the photosensitive drum 51 is a high speed, and not all four conditions in which printing of paper dust is harder to occur are satisfied, the circumferential speed of the developing roller 56 is determined so that the circumferential speed ratio of the developing roller 56 with respect to the photosensitive drum 51 falls in the range of 1.1 to 1.25, which is a relatively low value range. Printing of paper dust attached to the photosensitive drum 51 can be prevented from being strongly rubbed against the toner held by the developing roller 56 by rotatably driving the developing roller 56 at the circumferential speed. Therefore, printing of paper dust can certainly be prevented from occurring. Also, since the circumferential speed of the photosensitive drum 51 is a high speed, even when the circumferential speed ratio of the developing roller 56 with respect to the photosensitive drum 51 is set to a small value, a sufficient circumferential speed of the developing roller 56 can be obtained, and thus a sufficient toner can be supplied to the photosensitive drum 51. Therefore, both printing of paper dust and defective image forming caused by the insufficient toner supply to the photosensitive drum 51 can be prevented.

As a result, either in the fine mode or the high speed mode, both printing of paper dust and defective image forming caused by the insufficient toner supply to the photosensitive drum 51 can be prevented, and thus, high-quality images can always be formed.

Also, in the high speed mode in which the circumferential speed of the photosensitive drum is a high speed, with the circumferential speed ratio of the developing roller 56 with respect to the photosensitive drum 51 in the range of 1.1 to 1.25, the circumferential speed of the developing roller 56 is determined so that it becomes lower as the number of the conditions met among the four conditions is getting smaller, and the developing roller 56 is rotatably driven at that circumferential speed. Therefore, printing of paper dust in the high speed mode can certainly be prevented from occurring.

Furthermore, since printing of paper dust is harder to occur when the humidity is low, by including the condition that the humidity detected by the humidity sensor 84 is equal to or below a predetermined humidity set in advance (in the embodiment, 50%) in the four conditions, the circumferential speed ratio of the developing roller 56 with respect to the photosensitive drum 51 can certainly be made low in a situation when printing of paper dust is easy to occur. As a result, printing of paper dust can certainly be further prevented from occurring.

Furthermore, when thin paper is used as the paper 3, a relatively low transfer bias is applied to the transfer rollers 62, and thus printing of paper dust is harder to occur. In the contrary, when special paper is used as the paper 3, a relatively high transfer bias is applied to the transfer rollers 62, and thus the possibility that printing of paper dust will occur is higher. Therefore, by including the condition that thin paper is set as the type of the paper 3 in the four conditions, the circumferential speed ratio of the developing roller 56 with respect to the photosensitive drum 51 can certainly be made low in a situation when printing of paper dust would be easy to occur. As a result, printing of paper dust can certainly be further prevented from occurring.

Furthermore, when normal paper is used as the paper 3, printing of paper dust is harder to occur compared with the case when recycled paper, which is abnormal paper, is used, and thus, by including the condition that normal paper is set as the type of the paper 3 in the four conditions, the circumferential speed ratio of the developing roller 56 with respect to the photosensitive drum 51 can certainly be made low in a situation when printing of paper dust would be easy to occur. As a result, printing of paper dust can certainly be further prevented from occurring.

Furthermore, since printing of paper dust is harder to occur when the number of counts of image forming operations performed in the past (the number of counts that electrostatic latent images have been formed on the photosensitive drum 51) is small, by including the condition that the number of counts that the electrostatic latent images have formed is equal to or below a predetermined number in the plurality of conditions, the circumferential speed ratio of the developing roller 56 with respect to the photosensitive drum 51 can certainly be made low in a situation when printing of paper dust would be easy to occur. As a result, printing of paper dust can certainly be further prevented from occurring.

Furthermore, even though the polymerized toners obtained by polymerizing the polymerized monomers such as the styrene monomers, acrylic monomers, or the like, are used for toners of the respective colors, printing of paper dust can be prevented from occurring.

Furthermore, in the color laser printer 1, a toner of different color is supplied to each of the photosensitive drum 51. Therefore, by sequentially overlapping the toner images for the respective colors formed on each of the photosensitive drum 51, color images can be formed at an almost same speed as monochrome images.

Furthermore, since the so called cleanerless type in which the residual toners at each photosensitive drum 51 after the transfer of the toner image to the paper 3 is collected by the developing roller 56 is adopted, a toner cleaner device or a reserving unit for discharged toners is not needed, and thus the device structure is simplified.

Also, although in the present embodiment, whether the printer is in the high speed mode or the find mode, and the type of the paper 3 used in the color laser printer 1 can be set at the time of selection in the external device 90, the setting can also be accomplished by manipulating keys on a manipulation panel 3 provided to the color laser printer 1.

Also, although the present embodiment exemplified the case when the circumferential speed of the photosensitive drum 51 is changed in two steps, the circumferential speed of the photosensitive drum 51 may alternatively be changed in a finer manner (in three or more steps). In such case, in correspondence with the circumferential speed of the photosensitive drum 51, the circumferential speed of the developing roller 56 (circumferential speed ratio of the developing roller 56 with respect to the photosensitive drum 51) may also be set in a finer manner.

Furthermore, instead of any of the four conditions, or, in addition to them, another condition that the toner used in the color laser printer 1 is a crushed toner, and the like may be adopted. Since occurrence of printing of paper dust is rare when a crushed toner is used, by including such condition, the circumferential speed ratio of the developing roller 56 with respect to the photosensitive drum 51 can certainly be made low in a situation when printing of paper dust would be easy to occur. As a result, printing of paper dust can certainly be further prevented from occurring.

Also, the present embodiment exemplified the structure in which it is determined whether each of the four conditions defined in advance is met or not when the high speed mode is set, and the developing roller 56 is rotatably driven so that the circumferential speed ratio of the developing roller 56 with respect to the photosensitive drum 51 becomes the circumferential speed ratio that corresponds to the number of conditions met among the four conditions. However, the structure may be such that, for example, the determination of the four conditions is omitted, and, the developing roller 56 is rotatably driven so that the circumferential speed of the developing roller 56 with respect to the photosensitive drum 51 when the high speed mode is set is different from that when the high speed mode is not set. More specifically, the structure may be such that the developing roller is rotatably driven so that the circumferential speed ratio of the developing roller 56 with respect to the photosensitive drum 51 when the high speed mode is set is a predetermined value within the range of 1.1 to 1.25, whereas the circumferential speed ratio of the developing roller 56 with respect to the photosensitive drum 51 when the high speed mode is not set (when the fine mode is set) is a predetermined value within the range of 1.5 to 1.7.

Furthermore, the circumferential speed of the developing roller 56 may also be obtained by computation based on the circumferential speed of the photosensitive drum 51 during performing the circumferential speed determining process so that the circumferential speed ratio corresponds to the circumferential speed of the photosensitive drum 51. Also, various circumferential speeds of the developing roller 56 may be obtained in advance with respect to each of combinations between the circumferential speed ratios corresponding to the circumferential speeds of the photosensitive drum 51 and the circumferential speeds of the photosensitive drum 51, and the circumferential speed of the developing roller 56 may be set by selecting from the obtained values in advance in the circumferential speed determining process.

According to the embodiment, the developing roller driving unit that rotatably drives the developing roller is controlled so that the circumferential speed ratio of the developing roller with respect to the photosensitive drum becomes a circumferential speed ratio which corresponds to a circumferential speed of the photosensitive drum. Therefore, the circumferential speed of the developing roller can be made appropriate according to the circumferential speed of the photosensitive drum. As a result, both printing of paper dust and defective image forming caused by insufficient developing agent supply to the photosensitive drum can be prevented, and thus, high-quality images can always be formed.

According to the embodiment, the developing roller driving unit that rotatably drives the developing roller is controlled so that the circumferential speed ratio of the developing roller with respect to the photosensitive drum falls in the first circumferential speed ratio range, when the circumferential speed of the photosensitive drum is the first speed defined in advance, or when the number of conditions met among the plurality of conditions defined in advance is equal to or more than a predetermined number. On the other hand, the developing roller driving unit that rotatably drives the developing roller is controlled so that the circumferential speed ratio of the developing roller with respect to the photosensitive drum falls in the second circumferential speed ratio range which is lower than the first circumferential speed ratio range, when the circumferential speed of the photosensitive drum is the second speed which is higher than the first speed, and the number of conditions met among the plurality of conditions is below the predetermined number.

For example, when the circumferential speed of the photosensitive drum is the first speed which is lower than the second speed, or the number of conditions that are met under which printing of paper dust is harder to occur is equal to or above a predetermined number, printing of paper dust is harder to occur, and therefore, the circumferential speed of the developing roller is determined so that the circumferential speed ratio of the developing roller with respect to the photosensitive drum falls in the first circumferential speed ratio range, which is a relatively high value range than the second circumferential speed ratio range. Since printing of paper dust can be prevented by rotatably driving the developing roller at the circumferential speed, the circumferential speed of the developing roller can certainly be prevented from becoming too low. Therefore, both printing of paper dust and defective image forming caused by insufficient developing agent supply to the photosensitive drum can be certainly prevented.

On the other hand, when the circumferential speed of the photosensitive drum is the second speed which is higher than the first speed, and the number of conditions that are met under which printing of paper dust is harder to occur is below a predetermined number, the circumferential speed of the developing roller is determined so that the circumferential speed ratio of the developing roller with respect to the photosensitive drum falls in the second circumferential speed ratio range which is lower than the first circumferential speed ratio range. By rotatably driving the developing roller at the circumferential speed, paper dust attached to the photosensitive drum is certainly prevented from being strongly rubbed against the developing agent held by the developing roller. Therefore, printing of paper dust can be certainly prevented from occurring. Also, since the circumferential speed of the photosensitive drum is a high speed at that time, even when the circumferential speed ratio of the developing roller with respect to the photosensitive drum is set to a small value, a sufficient circumferential speed of the developing roller can be obtained, and thus, a sufficient developing agent can be supplied to the photosensitive drum.

According to the embodiment, both printing of paper dust and defective image forming caused by insufficient developing agent supply to the photosensitive drum can be certainly prevented, and thus, high-quality images can always be formed.

According to the embodiment, the developing roller driving unit that rotatably drives the developing roller is controlled so that the circumferential speed ratio of the developing roller with respect to the photosensitive drum falls in the first circumferential speed ratio range when the circumferential speed of the photosensitive drum is the first speed defined in advance. On the other hand, the developing roller driving unit that rotatably drives the developing roller is controlled so that the circumferential speed ratio of the developing roller with respect to the photosensitive drum falls in the second circumferential speed ratio range which is lower than the first circumferential speed ratio range when the circumferential speed of the photosensitive drum is the second speed which is higher than the first speed.

For example, since printing of paper dust is harder to occur when the circumferential speed of the photosensitive drum is the first speed which is lower than the second speed, the circumferential speed of the developing roller is determined so that the circumferential speed ratio of the developing roller with respect to the photosensitive drum falls in the first circumferential speed ratio range which is higher than the second circumferential speed ratio range. Since printing of paper dust can be prevented from occurring by rotatably driving the developing roller at the circumferential speed, the circumferential speed of the developing roller can certainly be prevented from becoming too low. Therefore, both printing of paper dust and defective image forming caused by insufficient developing agent supply to the photosensitive drum can be certainly prevented.

On the other hand, when the circumferential speed of the photosensitive drum is the second speed which is higher than the first speed, the circumferential speed of the developing roller is determined so that the circumferential speed ratio of the developing roller with respect to the photosensitive drum falls in the second circumferential speed ratio range which is lower than the first circumferential speed ratio range. By rotatably driving the developing roller at the circumferential speed, the paper dust attached to the photosensitive drum can be certainly prevented from being strongly rubbed against the developing agent held by the developing roller. Therefore, printing of paper dust can certainly be prevented from occurring. Also, since the circumferential speed of the photosensitive drum is high speed at that time, even when the circumferential speed ratio of the developing roller with respect to the photosensitive drum is set to a small value, a sufficient circumferential speed of the developing roller can be obtained, and thus a sufficient developing agent can be supplied to the photosensitive drum.

According to the embodiment, both printing of paper dust and defective image forming caused by insufficient developing agent supply to the photosensitive drum can be certainly prevented, and thus, high-quality images can always be formed.

According to the embodiment, the developing roller driving unit that rotatably drives the developing roller is controlled so that the circumferential speed ratio of the developing roller with respect to the photosensitive drum becomes the circumferential speed ratio, in the second circumferential speed ratio range, corresponding to the number of conditions met among the plurality of conditions defined in advance, when the circumferential speed of the photosensitive drum is the second speed. Therefore, if the plurality of conditions are various conditions under which printing of paper dust is harder to occur, the developing roller is rotatably driven so that the circumferential speed ratio of the developing roller with respect to the photosensitive drum becomes lower as the number of conditions met among the plurality of conditions is getting smaller, and thus, printing of paper dust can certainly be prevented from occurring.

According to the embodiment, since printing of paper dust is harder to occur when the humidity is low, by including the condition that the humidity detected by the humidity sensor is equal to or below a predetermined humidity in the plurality of conditions, the circumferential speed ratio of the developing roller with respect to the photosensitive drum can certainly be made low in a situation when printing of paper dust is easy to occur. As a result, printing of paper dust can certainly be further prevented from occurring.

According to the embodiment, since printing of paper dust is harder to occur when the transfer bias is low, in a case of including the bias switching unit that switches the transfer bias between the first bias and the second bias which is lower than the first bias, and by including the condition that the transfer bias is switched to the second bias in the plurality of conditions, the circumferential speed ratio of the developing roller with respect to the photosensitive drum can be certainly made low in a situation when printing of paper dust is easy to occur. As a result, printing of paper dust can certainly be further prevented from occurring.

According to the embodiment, when normal paper is used as the paper, printing of paper dust is harder to occur compared with the case when recycled paper is used, and thus, by including the condition that normal paper is used in the plurality of conditions, the circumferential speed ratio of the developing roller with respect to the photosensitive drum can certainly be made low in a situation when printing of paper dust would be easy to occur. As a result, printing of paper dust can certainly be further prevented from occurring.

According to the embodiment, since printing of paper dust is harder to occur when the number of counts that the electrostatic latent images have been formed on the photosensitive drum is small, by including the condition that the number of counts that the electrostatic latent images have occurred is equal to or below a predetermined number in the plurality of conditions, the circumferential speed ratio of the developing roller with respect to the photosensitive drum can certainly be made low in a situation when printing of paper dust would be easy to occur. As a result, printing of paper dust can certainly be further prevented from occurring.

According to the embodiment, printing of paper dust can be prevented from occurring even when the developing agent is a polymerized toner.

According to the embodiment, different color of developing agent from each other is supplied to each of the photosensitive drums. Therefore, by sequentially overlapping the developing agent images for the respective colors formed on each of the photosensitive drum, color images can be formed at an almost same speed as monochrome images.

According to the embodiment, since the so called cleanerless type in which the residual developing agent at each photosensitive drum is collected by the developing roller is adopted, a toner cleaner device or a reserving unit for discharged toners is not needed, and thus the device structure is simplified.

According to the embodiment, both printing of paper dust and defective image forming caused by insufficient developing agent supply to the photosensitive drum can be prevented, and thus, high-quality images can always be formed.

According to the embodiment, both printing of paper dust and defective image forming caused by insufficient developing agent supply to the photosensitive drum can be certainly prevented, and thus, high-quality images can always be formed.

According to the embodiment, both printing of paper dust and defective image forming caused by insufficient developing agent supply to the photosensitive drum can be certainly prevented, and thus, high-quality images can always be formed.

According to the embodiment, printing of paper dust can certainly be prevented from occurring.

According to another aspect of the invention, printing of paper dust can certainly be further prevented from occurring.

According to the embodiment, printing of paper dust can certainly be further prevented from occurring.

According to the embodiment, printing of paper dust can be prevented from occurring even when the developing agent is a polymerized toner.

According to the embodiment, by sequentially overlapping the developing agent images for the respective colors formed on each of the photosensitive drum, color images can be formed at an almost same speed as monochrome images.

According to the embodiment, a toner cleaner device or a reserving unit for discharged toners is not needed, and thus the device structure is simplified.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined solely by the following claims and their equivalents.

What is claimed is:

1. An image forming apparatus, comprising:

a photosensitive drum on which an electrostatic latent image is formed;

a developing roller that is disposed facing the photosensitive drum and supplies a developing agent to the electrostatic latent image formed on the photosensitive drum to develop the electrostatic latent image to a developing agent image;

a photosensitive drum driving unit that rotatably drives the photosensitive drum;

a developing roller driving unit that rotatably drives the developing roller; and a driving control unit that controls the photosensitive drum driving unit, and controls the developing roller driving unit so that a circumferential speed ratio of the developing roller with respect to the photosensitive drum varies according to a circumferential speed of the photosensitive drum when the developing roller supplies the developing agent to the electrostatic latent image formed on the photosensitive drum.

2. The image forming apparatus according to claim 1, wherein the driving control unit controls the developing roller driving unit so that the circumferential speed ratio of the developing roller with respect to the photosensitive drum falls in a first circumferential speed ratio range, when the circumferential speed of the photosensitive drum is a first speed defined in advance, or when a number of conditions among a plurality of conditions defined in advance is equal to or more than a predetermined number; and the driving control unit controls the developing roller driving unit so that the circumferential speed ratio of the developing roller with respect to the photosensitive drum falls in a second circumferential speed ratio range which is lower than the first circumferential speed ratio range, when the circumferential speed of the photosensitive drum is a second speed which is higher than the first speed, and the number of conditions among the plurality of conditions is below the predetermined number.

3. The image forming apparatus according to claim 1, wherein the driving control unit controls the developing roller driving unit so that the circumferential speed ratio of the developing roller with respect to the photosensitive drum falls in a first circumferential speed ratio range, when the circumferential speed of the photosensitive drum is a first speed defined in advance; and the driving control unit controls the developing roller driving unit so that the circumferential speed ratio of the developing roller with respect to the photosensitive drum falls in a second circumferential speed ratio range which is lower than the first circumferential speed ratio range, when the circumferential speed of the photosensitive drum is a second speed which is higher than the first speed.

4. The image forming apparatus according to claim 3, wherein the driving control unit controls the developing roller driving unit so that the circumferential speed ratio of the developing roller with respect to the photosensitive drum becomes the circumferential speed ratio corresponding to the number of conditions met among the plurality of conditions defined in advance, when the circumferential speed of the photosensitive drum is the second speed.

5. The image forming apparatus according to claim 2, further comprising:

a humidity detecting unit that detects a humidity of environment of the developing roller, wherein the plurality of conditions comprise a condition that the humidity detected by the humidity detecting unit is equal to or below a predetermine humidity.

6. The image forming apparatus according to claim 2, further comprising:

a transfer unit to which a transfer bias is applied for transferring the developing agent image on the photosensitive drum to a recording medium by the transfer bias; and a bias switching unit that switches the transfer bias applied to the transfer unit between a first bias and a second bias which is lower than the first bias;

wherein the plurality of conditions comprise a condition that the transfer bias applied to the transfer unit by the bias switching unit is switched to the second bias.

7. The image forming apparatus according to claim 2, wherein normal paper and abnormal paper other than normal paper can be used as the recording medium on which the developing agent image on the photosensitive drum are transferred; and the plurality of conditions comprise a condition that normal paper is used as the recording medium.

8. The image forming apparatus according to claim 2, further comprising:

a count storing unit that stores a number of counts that the electrostatic latent image has been formed on the photosensitive drum;

wherein the plurality of conditions comprise a condition that the number of counts stored in the count storing unit is equal to or below a predetermined number of counts.

9. The image forming apparatus according to claim 1, wherein the developing agent is a polymerized toner.

10. The image forming apparatus according to claim 1, wherein a plurality of the photosensitive drums are provided, and the developing roller is provided to each photosensitive drum, and the developing roller supplies different color of developing agent from each other to each photosensitive drum.

11. The image forming apparatus according to claim 10, wherein the developing roller collects the developing agent remaining on each photosensitive drum.

12. An image forming method, comprising:

controlling a developing roller driving unit so that a circumferential speed ratio of a developing roller with respect to a photosensitive drum falls in a first circumferential speed ratio range, when a circumferential speed of a photosensitive drum is a first speed defined in advance, or when a number of conditions among a plurality of conditions defined in advance is equal to or more than a predetermined number; and controlling the developing roller driving unit so that the circumferential speed ratio of the developing roller with respect to the photosensitive drum falls in a second circumferential speed ratio range which is lower than the first circumferential speed ratio range, when the circumferential speed of the photosensitive drum is a second speed which is higher than the first speed, and the number of conditions among the plurality of conditions is below the predetermined number.

13. A storage medium readable by a processor, the storage medium storing a program of instructions executable by the processor to perform a function for controlling an image forming apparatus, the function, comprising:

controlling a developing roller driving unit so that a circumferential speed ratio of a developing roller with respect to a photosensitive drum falls in a first circumferential speed ratio range, when a circumferential speed of a photosensitive drum is a first speed defined in advance, or when a number of conditions among a plurality of conditions defined in advance is equal to or more than a predetermined number; and controlling the developing roller driving unit so that the circumferential speed ratio of the developing roller with respect to the photosensitive drum falls in a second circumferential speed ratio range which is lower than the first circumferential speed ratio range, when the circumferential speed of the photosensitive drum is a second speed which is higher than the first speed, and the number of conditions among the plurality of conditions is below the predetermined number.

14. The image forming apparatus according to claim 4, further comprising:

a humidity detecting unit that detects a humidity of environment of the developing roller, wherein the plurality of conditions comprise a condition that the humidity detected by the humidity detecting unit is equal to or below a predetermine humidity.

15. The image forming apparatus according to claim 4, further comprising:

a transfer unit to which a transfer bias is applied for transferring the developing agent image on the photosensitive drum to a recording medium by the transfer bias; and a bias switching unit that switches the transfer bias applied to the transfer unit between a first bias and a second bias which is lower than the first bias;

wherein the plurality of conditions comprise a condition that the transfer bias applied to the transfer unit by the bias switching unit is switched to the second bias.

16. The image forming apparatus according to claim 4, wherein normal paper and abnormal paper other than normal paper can be used as the recording medium on which the developing agent image on the photosensitive drum are transferred; and the plurality of conditions comprise a condition that normal paper is used as the recording medium.

17. The image forming apparatus according to claim 4, further comprising:

a count storing unit that stores a number of counts that the electrostatic latent image has been formed on the photosensitive drum;

wherein the plurality of conditions comprise a condition that the number of counts stored in the count storing unit is equal to or below a predetermined number of counts.

18. The image forming apparatus according to claim 1, wherein the circumferential speed of the photosensitive drum is determined based on a print mode of the image forming apparatus.

19. The image forming apparatus according to claim 18, wherein the print mode includes a first mode and a second mode;

wherein in the first mode, the driving control unit controls the photosensitive drum driving unit to drive the photosensitive drum at a first speed, and wherein in the second mode, the driving control unit controls the photosensitive drum driving unit to drive the photosensitive drum at a second speed higher than the first speed.

20. The image forming apparatus according to claim 19, wherein the driving control unit controls the developing roller driving unit so that the circumferential speed ratio falls in a first circumferential speed range when the image forming apparatus is in the first mode; and wherein the driving control unit controls the developing roller driving unit so that the circumferential speed ratio falls in a second circumferential range which is lower than the first circumferential speed range when the image forming apparatus is in the second mode.

* * * * *